US008347416B1

(12) United States Patent
Query

(10) Patent No.: US 8,347,416 B1
(45) Date of Patent: Jan. 8, 2013

(54) METHOD AND APPARATUS FOR MODIFYING AN ARTICLE OF CLOTHING

(76) Inventor: Lisa Query, Lake Charles, LA (US)

( * ) Notice: Subject to any disclaimer, the term of this patent is extended or adjusted under 35 U.S.C. 154(b) by 148 days.

(21) Appl. No.: 12/814,059

(22) Filed: Jun. 11, 2010

(51) Int. Cl.

| | |
|---|---|
| ***A41F 1/00*** | (2006.01) |
| ***A44B 1/18*** | (2006.01) |
| *A41D 27/08* | (2006.01) |
| *A44B 1/04* | (2006.01) |

(52) U.S. Cl. ..... 2/265; 2/244; 2/257; 2/263; 24/114.12

(58) Field of Classification Search ..... 2/244–246, 2/257, 263, 265, 279, 312–322; 24/9 C, 24/9 A, 92, 9 E, 459, 343
See application file for complete search history.

(56) References Cited

U.S. PATENT DOCUMENTS

| | | | | | |
|---|---|---|---|---|---|
| 397,811 | A | * | 2/1889 | Messimer | 24/185 |
| 567,195 | A | * | 9/1896 | Paramore | 24/465 |
| 686,690 | A | * | 11/1901 | Fishel | 24/316 |
| 1,399,730 | A | * | 12/1921 | Abe | 24/470 |
| 1,828,041 | A | * | 10/1931 | Hamacher | 24/474 |
| 2,132,876 | A | * | 10/1938 | Myers | 2/245 |
| 2,302,341 | A | * | 11/1942 | Nash | 24/479 |
| 2,333,428 | A | * | 11/1943 | Kinsey | 2/270 |
| 2,454,103 | A | * | 11/1948 | Swidersky | 24/459 |
| 2,594,475 | A | * | 4/1952 | Meyer | 24/358 |
| 2,693,014 | A | * | 11/1954 | Monahan | 24/572.1 |
| 2,983,009 | A | * | 5/1961 | Dritz | 24/113 R |
| 3,017,641 | A | * | 1/1962 | Stollman | 2/322 |
| 3,065,946 | A | * | 11/1962 | Berkow | 248/317 |
| 3,184,760 | A | * | 5/1965 | Anstey et al. | 2/312 |
| 3,407,523 | A | * | 10/1968 | Winston | 40/1.5 |
| 3,484,974 | A | * | 12/1969 | Culmone | 40/586 |
| 3,530,550 | A | * | 9/1970 | White | 24/464 |
| 3,777,315 | A | * | 12/1973 | Norfolk | 2/321 |
| 3,865,290 | A | * | 2/1975 | Sperling | 224/194 |
| 3,879,808 | A | * | 4/1975 | Alberts | 24/109 |
| 3,890,678 | A | * | 6/1975 | Leonard, Jr. | 24/66.9 |
| 3,908,236 | A | * | 9/1975 | Shepherd | 24/114.3 |
| 4,167,053 | A | * | 9/1979 | Ptasinski et al. | 24/113 R |
| 4,175,305 | A | * | 11/1979 | Gillis | 24/459 |
| 4,198,733 | A | | 4/1980 | Ferguson et al. | |
| 4,308,647 | A | * | 1/1982 | Gillis | 24/460 |
| 4,387,488 | A | | 6/1983 | Kanzaka | |
| 4,559,675 | A | * | 12/1985 | Devenny | 24/5 |
| 4,654,934 | A | | 4/1987 | Hasegawa | |
| 4,665,591 | A | * | 5/1987 | Servay | 24/163 K |
| 4,710,979 | A | * | 12/1987 | Bull et al. | 2/48 |

(Continued)

*Primary Examiner* — Bobby Muromoto, Jr.
(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for modifying an article of clothing employs a button or disk and an oval shaped or elongated receiver or collar. A shirt, blouse, dress or other article of clothing can be modified at any selected location(s) by placing the disk or button behind a portion of the fabric of the article of clothing, encapsulating or twisting the button or disk so that it is covered with the fabric, then pushing the fabric covered button or disk through a second layer or section of the article of clothing. The disk or button with both sections of fabric are then passed through a central elongated opening of the collar or receiver. The collar or receiver then retains the button and the portions of the article of clothing in a position that produces a gathering of fabric, thus modifying the design or look of the garment.

17 Claims, 3 Drawing Sheets

U.S. PATENT DOCUMENTS 4,723,323 A * 2/1988 Wright, Jr. ..... 2/48
4,774,726 A * 10/1988 Garrett ..... 2/105
4,985,968 A * 1/1991 Hooper ..... 24/302
5,005,218 A * 4/1991 Ganz ..... 2/69
5,046,222 A * 9/1991 Byers et al. ..... 24/343
5,075,938 A * 12/1991 Hutchinson ..... 24/464
5,113,553 A * 5/1992 Hutchinson ..... 24/464
5,156,023 A * 10/1992 Bevolo ..... 63/20
5,195,220 A * 3/1993 Herman ..... 24/113 R
5,222,259 A * 6/1993 Bristor ..... 2/115
5,511,289 A * 4/1996 Melia ..... 24/66.9
5,557,830 A * 9/1996 Davis ..... 24/459
5,655,271 A * 8/1997 Maxwell-Trumble et al. . 24/459
5,765,232 A * 6/1998 Pryor ..... 2/217
5,901,372 A * 5/1999 Lawler ..... 2/69
6,038,702 A * 3/2000 Knerr ..... 2/244
6,053,182 A * 4/2000 Harmell ..... 132/275
6,199,247 B1 * 3/2001 Tsai ..... 24/343
6,223,399 B1 * 5/2001 Chen ..... 24/3.1
6,243,925 B1 * 6/2001 Aszody ..... 24/343
6,295,703 B1 * 10/2001 Adams et al. ..... 24/459
6,718,600 B1 * 4/2004 Gillis ..... 24/459
7,216,404 B1 * 5/2007 Doyle ..... 24/573.11
7,793,361 B2 * 9/2010 Ishihara et al. ..... 2/170
2003/0014844 A1 * 1/2003 Splane, Jr. ..... 24/3.1

* cited by examiner

METHOD AND APPARATUS FOR MODIFYING AN ARTICLE OF CLOTHING

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to articles of clothing. More particularly, the present invention relates to an improved method and apparatus for modifying a garment or an article of clothing wherein a shirt, blouse, dress or other article of clothing can be modified at any selected location of the garment or article of clothing by placing a disk or button behind the fabric of the article of clothing, encapsulating or twisting the button or disk, then pushing the button or disk with the layer of fabric through a second layer of clothing for the same article and then a central elongated opening of a collar or receiver. The collar or receiver then retains the button and the article of clothing in a position that produces a gathering of fabric to a viewer.

2. General Background of the Invention

Clasps, fasteners, clips have been used to engage, grip or attach to fabric. The following table lists examples of such patented constructions.

TABLE

| Pat. No. | Title | Date of Patent |
|---|---|---|
| 1,828,041 | GARTER CONSTRUCTION | Oct. 20, 1931 |
| 2,302,341 | CLASP | Nov. 17, 1942 |
| 2,983,009 | COVERED BUTTON | May 9, 1961 |
| 3,879,808 | REMOVABLE GARMENT BUTTON | Apr. 29, 1975 |
| 3,908,236 | TUFTING BUTTON | Sep. 30, 1975 |
| 4,167,053 | FABRIC-COVERED BUTTON AND THE METHOD FOR FABRICATING SAME | Sep. 11, 1979 |
| 4,175,305 | CLIP FOR GRIPPING FABRIC OR THE LIKE | Nov. 27, 1979 |
| 4,198,733 | FABRIC COVERED BUTTON | Apr. 22, 1980 |
| 4,308,647 | CLIP FOR GRIPPING FABRIC OR THE LAKE | Jan. 5, 1982 |
| 4,387,488 | FABRIC-COVERED BUTTON | Jun. 14, 1983 |
| 4,654,934 | COVERED BUTTON | Apr. 7, 1987 |

BRIEF SUMMARY OF THE INVENTION

The present invention provides a method and apparatus that is designed to change or enhance the fashion of a ladies top or blouse or other garment or article of clothing.

The method and apparatus of the present invention enables a user to change the look of the garment as originally created, thus appearing as though the garment where actually sewn in a different way.

Because of the unique construction of the two portions of the apparatus, they can be attached to a garment in such a way that the garment appears to be pleated at the site of application.

Depending on where the apparatus is installed on a shirt or blouse or other garment, that garment then appears to have draped style, empire style, or pulled in at a side such as for example to enhance the wearer's waist. The method and apparatus of the present invention can be applied to any area of an article of clothing such as in the bust area, in the waist area, or across the top of a blouse giving a pleated look.

Placed at the center at waist level, the user can disguise unsightly belly bulge with the pleating caused by the gathering of the fabric.

The method and apparatus of the present invention can be use to attach an accessory to the blouse such as a belt or buckle or other accessory. The belt can then be tied back or brought to the front and tied or just left hanging, as examples.

The method and apparatus of the present invention enable other accessories such as a scarf to be attached to the blouse as well. Such a scarf can be attached in a drape fashion, making the blouse to appear to have a belt or scarf sewn to it.

When the apparatus of the present invention is removed from a garment, the garment such as a blouse returns to its original condition. The method and apparatus of the present invention provides a disk or button and a collar or receiver that can be made of any material such as flexible plastic, thus being reusable many times.

The method of the present invention begins with the use of one of the parts of the apparatus, a button or disk which can be generally circular. This button or disk is placed under the garment, such as a shirt. The user's fingers then grasp the button from the outside of the shirt causing the button to be completely covered in fabric.

A receiver or collar piece is also placed under the shirt or garment. The fingers of the user grasp the receiver or collar. The user forces the button or disk. (now encapsulated in the fabric) through the central opening of the collar or receiver. This action is performed from the outside of the blouse, resulting in the fabric covered button being pushed into the central opening of the receiver or collar, thus successfully capturing two fabric portions or areas of the shirt together in the same location. The present invention enables a user to create a slimming effect to the garment. It can transform any shapeless, baggy blouse into a form fitting one with the installation of the apparatus. Application of the apparatus of the present invention can be either on the side of the blouse, on each side of the blouse or even one or more placed in the back of the blouse.

The method and apparatus of the present invention can be used in the bust area to create a horizontal gathering of fabric that enhances the bust area visually, also causing fabric to drape down the front of the shirt in an attractive manner. The method and apparatus of the present invention can be used to add a buckle or scarf, further enhancing the look of the shirt for the wearer.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
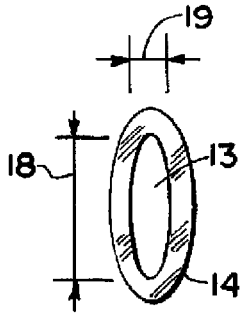
FIG. 1 is a partial perspective view of a preferred embodiment of the apparatus and present invention.

FIGS. 8-14 are perspective views of a preferred embodiment of the apparatus of the present invention designated generally by the numeral 10. The apparatus 10 and method of the present invention employs a disk or button 11 and a receiver or collar 14 having an opening or slot 13 (see FIGS. 1-2). In FIG. 2, there is shown a button which can be in the form of a circular disk, designated generally by the numeral 11. Disk or button 11 has a diameter 12 that is smaller than the largest dimension 18 of the elongated slot 13 of receiver or collar 14.

Receiver or collar 14 can be generally oval in shape, having central opening or slot 13 which is elongated. By making the slot or central opening 13 longer (arrow 18) than the diameter 12 of disk 11, the disk or button 11 will fit through the elongated slot 13 even after the button or disk 11 has been wrapped or encapsulated in one or more layers 15 of an article of clothing 16 or other garment, such as a layer 15 of the shirt 16 of FIGS. 10 and 16.

Figure 5:
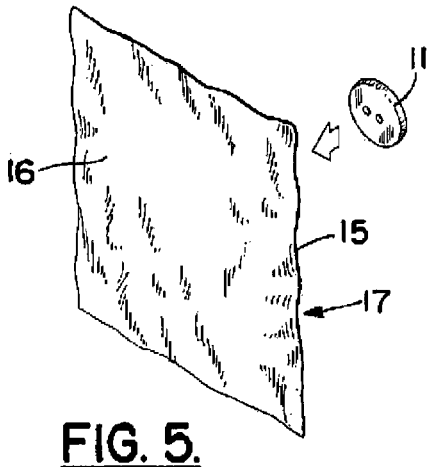
FIG. 5 is partial perspective view of a preferred embodiment of the apparatus of the present invention.

In FIG. 5, the disk or button 11 has been placed upon the rear surface 17 of a layer of fabric material which is designated by the numeral 15. The layer 15 of fabric material can be part of any selected garment, such as a blouse or shirt of FIGS. 10 and 16 or other garment 16.

Figure 6:
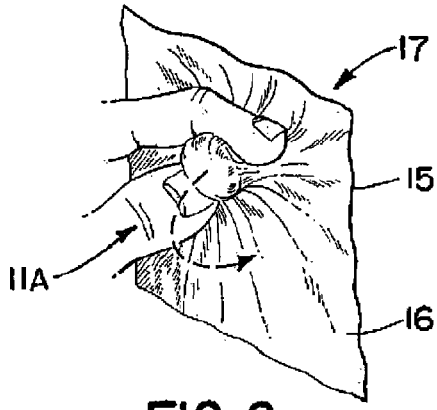
FIG. 6 is a partial perspective view of a preferred embodiment of the apparatus of the present invention and illustrating the method of the present invention.
Figure 7:
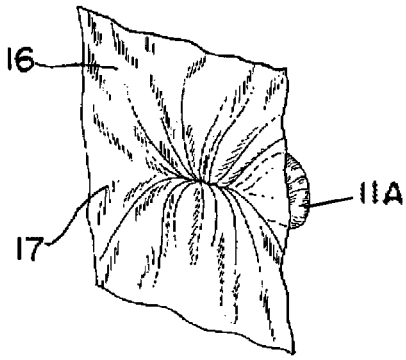
FIG. 7 is a partial perspective view of a preferred embodiment of the apparatus of the present invention and illustrating the method of the present invention.
Figure 8:
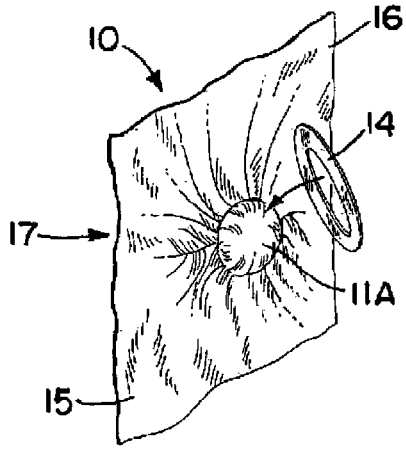
FIG. 8 is a partial perspective view of a preferred embodiment of the apparatus of the present invention and illustrating the method of the present invention.
Figure 15:
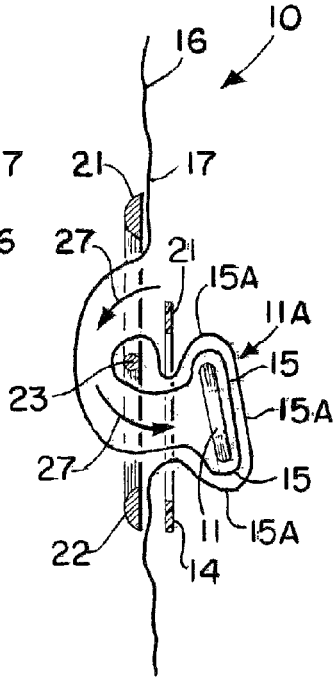
FIG. 15 is a sectional view illustrating the method of the present invention.
Figure 16:
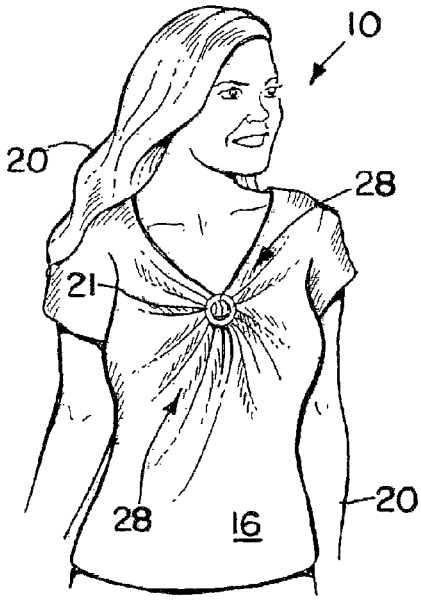
FIG. 16 is a perspective view of a preferred embodiment of the apparatus of the present invention and showing the apparatus as applied to the shirt of a wearer using the method of the present invention.

In order to begin the assembly of the apparatus 10 of the present invention to the garment 16, a user places a button or disk 11 against the rear surface 17 of the section of material 15 as shown in FIGS. 15-16. The user then encapsulates the disk 11 with the fabric material 15 as shown in FIGS. 6-8. The fabric encapsulated or covered disk is numbered 11A. The disk 11A covered or encapsulated with a layer 15 of the garment 16 is then inserted through the elongated slot 13 of the receiver 14, catching a second layer 15A of fabric material 15 (see FIGS. 5-8 and 14-15).

Figure 2:
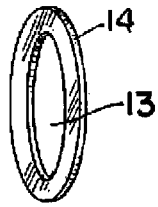
FIG. 2 is a partial perspective view of a preferred embodiment of the apparatus and present invention.
Figure 3:
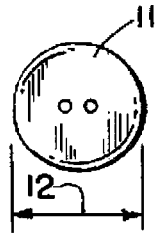
FIG. 3 is a partial perspective view of a preferred embodiment of the apparatus of the present invention.
Figure 4:
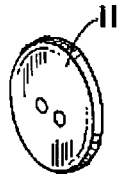
FIG. 4 is a partial perspective view of a preferred embodiment of the apparatus of the present invention.
Figure 9:
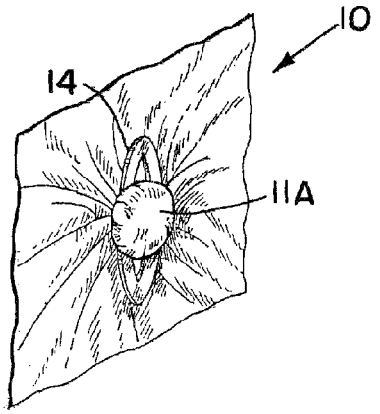
FIG. 9 is a partial perspective view of a preferred embodiment of the apparatus of the present invention and illustrating the method of the present invention.
Figure 10:
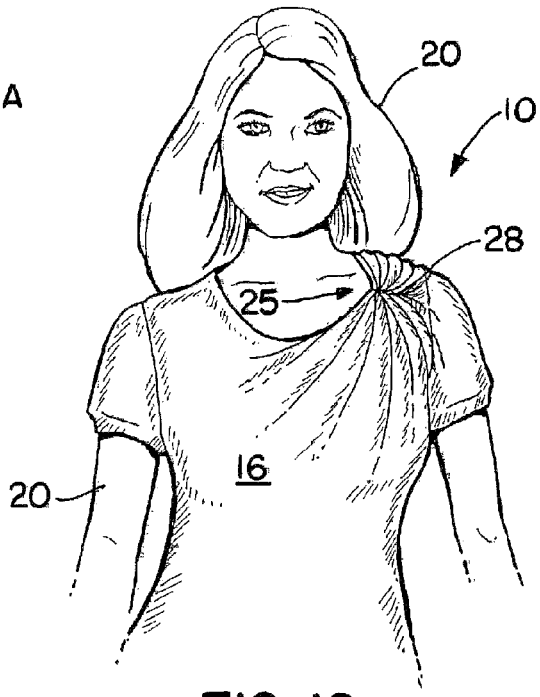
FIG. 10 is a perspective view illustrating a preferred method and apparatus of the present invention after application to the shirt of a wearer in the shoulder area.

Because the disk 11 has a diameter 12 that is larger than the width or small transverse dimension 19 of receiver 14 slot 13 shown in FIG. 1, the receiver or collar 14 will be retained to the encapsulated disk 11A after the disk 11 and fabric layer 15 are inserted through the central opening 13 (see FIG. 9). The effect of this method is to encapsulate a first portion or layer 15 of the fabric of the garment 16 around the disk or button 11 and then retain that encapsulated disk 11 with the collar or receiver 14 after the encapsulated disk 11A passes through a second layer or portion 15A of fabric (see FIGS. 14-15) to create a pleated look or design or effect 28 such as is shown in FIGS. 10 and 16.

The method an apparatus of the present invention enables a wearer to affix any accessory such as the buckle 21 shown in FIGS. 11 and 13-16. It should be understood that the buckle or accessory piece 21 could be any accessory piece such as a belt, scarf, or other accessory.

Figure 11:
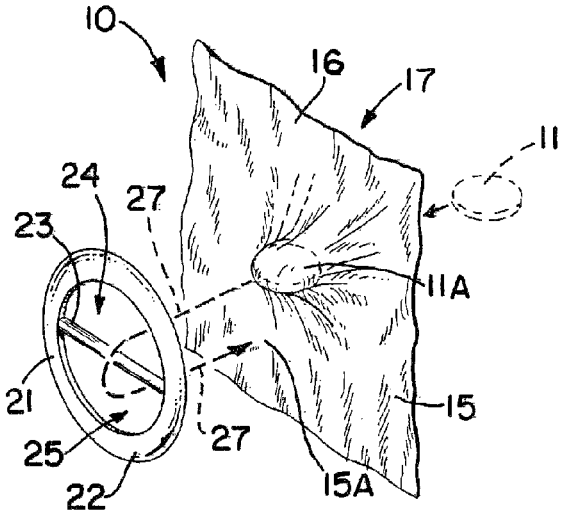
FIG. 11 is a partial perspective view of a preferred embodiment of the apparatus of the present invention illustrating use of the method with a buckle.

For the accessory piece 21 in the form of a buckle, the buckle 21 can have an annular member 22 and a crossbar 23 as shown. The annular member 22 and crossbar 23 thus provide a pair of openings 24, 25 on opposing sides of the crossbar 23 as seen in FIG. 11.

Figure 12:
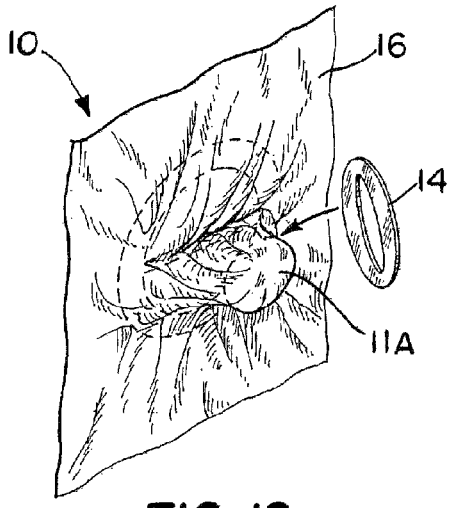
FIG. 12 is a partial perspective view of a preferred embodiment of the apparatus of the present invention illustrating use of the method with a buckle.
Figure 13:
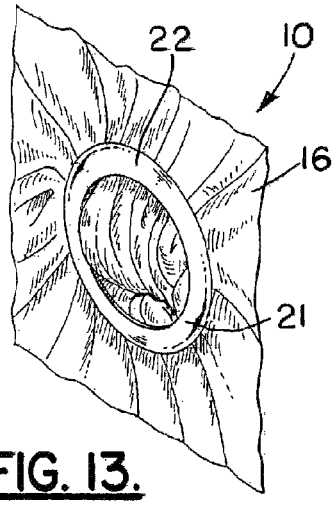
FIG. 13 is a partial perspective view of a preferred embodiment of the apparatus of the present invention illustrating use of the method with a buckle.
Figure 14:
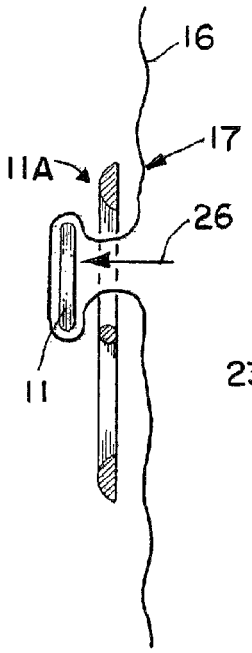
FIG. 14 is a sectional view illustrating the method of the present invention.

FIGS. 11-16 illustrate the method of the present invention when used to affix an accessory piece 21 (e.g. buckle) to the garment 16. The disk or button 11 is placed against the rear surface 17 of the garment 16 at a selected location shown in FIG. 11. Once the disk or button 11 is covered with the fabric layer 15 of the garment 16, it is first inserted through opening 24, passing over crossbar 23 and then traveling through opening 25 as illustrated by the arrow 27 in FIGS. 11 and 15. After the encapsulated disk or button 11A passes first through opening 24, then travels around crossbar 23, and then passes through opening 25, it engages a second layer 15A of the garment 16 as shown by arrows 26, 27 in FIGS. 11 and 15. The combination of disk 11 and the two layers 15, 15A of the garment 16 are then retained with the receiver 21 as shown in FIGS. 12 and 15.

A pleated or gathered look for the garment 16 is then provided at a selected area as shown in FIG. 16 thus displaying the accessory piece 21 and the pleated look 28. In FIG. 10, the pleated look 28 is shown without an accessory.

PARTS LIST

The following is a list of suitable parts and materials for the various elements of the preferred embodiment of the present invention.

| Parts Number | Description |
|---|---|
| 10 | clothing design modification system |
| 11 | button/disk |
| 11A | encapsulated/covered disk |
| 12 | diameter |
| 13 | elongated slot |
| 14 | collar/receiver |
| 15 | fabric layer/fabric portion |
| 15A | second layer/fabric portion |
| 16 | garment/article of clothing |
| 17 | rear surface |
| 18 | layer dimension of slot |
| 19 | smaller dimension of slot |

-continued

| Parts Number | Description |
|---|---|
| 20 | wearer |
| 21 | buckle/accessory piece |
| 22 | annular member |
| 23 | cross bar |
| 24 | opening |
| 25 | opening |
| 26 | arrow |
| 27 | arrow |
| 28 | gathered/pleated area |

The foregoing embodiments are presented by way of example only; the scope of the present invention is to be limited only by the following claims.

The invention claimed is:

1. A method of modifying the look of a garment, comprising the steps of:

a) providing a garment that includes a layer of material, a disk having a diameter, and a receiver having an oval shaped opening with a longitudinal dimension that is larger than the diameter and a transverse dimension smaller that the diameter;

b) placing the disk on the rear surface of the layer of material at a selected first location;

c) encapsulating the disk with a first portion of the layer of material of the garment;

d) encapsulating the disk of step "c" with a second portion of the layer of material of the garment at a second location that is spaced away from the first location of step "b";

e) placing the receiver over the combination of disk and the first and second portions of the layer of material of the garment; and f) wherein the disk in step "e" is encapsulated by two layers of garment material.

2. The method of claim 1 wherein the garment is a shirt.

3. The method of claim 1 wherein the garment is a dress.

4. The method of claim 2 wherein the first location is the waist area of the shirt.

5. The method of claim 2 wherein the first location is the bust area of the shirt.

6. The method of claim 2 wherein the first location is the neck area of the shirt.

7. The method of claim 1 further comprising the step of securing an accessory to the garment in between steps "c" and "d" wherein the accessory is secured at a position in between the first and second locations.

8. The method of claim 7 wherein the accessory is a buckle.

9. The method of claim 7 wherein the accessory is a scarf.

10. A method of modifying the look of a garment, comprising the steps of:

a) providing a garment, a disk having a diameter, and a receiver having an elongated opening, the opening having a length that is larger than the diameter and a width that is smaller that the diameter;

b) placing the disk on the rear surface of the garment at a selected location;

c) encapsulating the disk with a first portion of the garment;

d) encapsulating the disk of step "c" with a second portion of the garment at a second location that is spaced away from the location of step "b"; and e) placing the receiver over the combination of disk and first and second portions of the garment.

11. A garment, comprising:

a) a clothing article having a first surface and a second surface;

b) a disk having a diameter;

c) a receiver having an elongated opening with a longitudinal dimension larger than the diameter of the disk and a transverse dimension smaller that the diameter of the disk;

d) the disk occupying a position on the first surface of the clothing article at a selected first location;

e) the disk being encapsulated with a first portion of the garment;

f) the encapsulated disk engaging the clothing article at a second location that is spaced away from the first location; and g) the receiver engaging the disk and the clothing article at the second location, wherein the receiver holds the disk to first and second spaced apart portions of the clothing article.

12. The garment of claim 11 wherein the receiver opening is generally in the shape of an oval.

13. The garment of claim 11 further comprising an accessory that is secured to the clothing article with the combination of disk, garment portions and receiver.

14. The garment of claim 13 wherein the accessory is a buckle.

15. The garment of claim 13 wherein the accessory has one or more openings and the garment encapsulated disk occupies said opening.

16. The garment of claim 13 wherein the accessory has a pair of openings and the garment encapsulated disk occupies said openings.

17. The garment of claim 12 wherein the garment is a shirt.

* * * * *